United States Patent [19]

Charest et al.

[11] Patent Number: 5,071,680

[45] Date of Patent: Dec. 10, 1991

[54] METHOD FOR MAKING DECORATIVE INLAIDS

[75] Inventors: Claude L. Charest; Jean-François Courtoy, both of St-Bruno, Canada

[73] Assignee: Domco Industries Ltd., Farnham, Canada

[21] Appl. No.: 553,319

[22] Filed: Jul. 17, 1990

[51] Int. Cl.[5] ..... B05D 5/00

[52] U.S. Cl. ..... 427/278; 427/294; 427/388.5; 427/407.1; 428/49

[58] Field of Search ..... 118/600; 427/294, 296, 427/407.1, 278, 388.5; 428/49, 143

[56] References Cited

U.S. PATENT DOCUMENTS

| | | | |
|---|---|---|---|
| 1,567,091 | 12/1925 | Tone | 428/49 X |
| 3,126,296 | 3/1964 | Moutaud | 427/294 X |
| 3,293,108 | 12/1966 | Nairn et al. | 156/78 X |
| 4,017,658 | 4/1977 | Bomboire | 427/258 X |
| 4,054,699 | 10/1977 | Brinkley | 428/49 X |
| 4,196,244 | 4/1980 | Roman | 428/247 X |
| 4,212,691 | 7/1980 | Potosky et al. | 427/180 |
| 4,236,484 | 12/1980 | Lapp et al. | 427/294 |
| 4,440,826 | 4/1984 | Witman | 156/62.2 X |
| 4,794,020 | 12/1988 | Lussi et al. | 427/195 |

*Primary Examiner*—Shrive Beck
*Assistant Examiner*—Alain Bashore
*Attorney, Agent, or Firm*—Fleit, Jacobson, Cohn, Price, Holman & Stern

[57] ABSTRACT

The disclosure herein describes an improved method for making decorative inlaid types of sheet materials which consists of forming, on a sheet of flexible substrate, a layer of plastisol or organosol containing resinous porous particles. The improvement consists in blending the resinous porous particles with the plastisol or organosol by slow agitation, under vacuum.

17 Claims, 1 Drawing Sheet

METHOD FOR MAKING DECORATIVE INLAIDS

FIELD OF THE INVENTION

The present invention relates to a method for making decorative inlaids of the type that includes chips of resinous porous material More particularly, the present invention relates to a method for making such inlaids which are used as floor or wall coverings.

BACKGROUND OF THE INVENTION

Various methods are known for embedding chips into a clear plastisol in order to make decorative inlaid patterns.

U.S. Pat. No. 4,440,826 issued Apr. 3, 1984 to Armstrong World Industries, Inc describes translucent or transparent chips, having a thickness dimension not less than the thickness of the layer of material, applied to the surface thereof; the material is warmed and the structure is consolidated to push the chips down into the layer of material until they contact the underlying surface.

U.S. Pat. No. 4,212,691 issued July 15, 1980 to Congoleum Corporation describes a method for making decorative inlaid types of resilient sheet materials by spreading the chips onto the wet plastisol layer as a full coverage; the excess of chips are then removed and the remaining chips are pressed into the plastisol using calender devices.

U.S. Pat. No. 4,794,020 issued Dec. 27, 1988 to Tarkett Inc. describes a process for making sheet vinyl covering materials by first depositing resinous particles on a wet ungelled layer of PVC plastisol or organosol, removing the excess and then passing the sheet between a heated, cylindrical surface and a means for gradually and uniformally increasing the contact pressure between the cylindrical surface and the coated surface of the sheet.

In the methods of the prior art, especially with the inlaids described in the Congoleum patent, it is not possible to evenly distribute the particles on the surface less than full coverage. It is therefore difficult, in some instances, to see the printed design which usually is defined on the inlaid; further, each chip does not appear as a single particle. In the case of the inlaids of the Tarkett patent, air is entrapped in the resinous porous particles during the embedding step.

It has been found that some products on the market are stiff; in other cases, they are difficult to fold in corners and at the perimeter thereby making them difficult to install.

OBJECTS AND STATEMENT OF THE INVENTION

It is an object of the present invention to provide an improved process for the making of decorative inlaid types of sheet material which comprises forming, on a sheet of flexible substrate, a plastic layer of plastisol or organosol containing resinous porous particles. In order to provide a higher bond of the particles with the plastisol and a superior continuous layer, the coating containing the chips is deaerated under vacuum. All PVC dry blends are porous and intrinsically contain air. When the particles are embedded in the plastisol, the air is entrapped. Subsequently, when heating to fuse the product, the air will expand because the matrix reduces its viscosity and a foamy particle which has poor contact with the transparent matrix, is formed. Foamy particles in an inlaid results in a reduction of wear resistance properties and of appearance retention.

An additional feature of using a vaccumed chip and plastisol mixture is to create a positive pressure from the plastisol onto the particles, which pressure will prevent the pigments coated on the particles to migrate to the plastisol.

Another object of the present invention is to provide a method wherein the PVC dry blend chips are added into the clear plastisol which has previously been deaerated under vacuum, in a mixer equipped with a mass agitator. In order to prevent the pigments from migrating from the dry blend particles to the plastisol, which could lead to a lack of medium clarity, the mixture is blended by slow agitation, under vacuum. This provides a better chip appearance without obscuring the under layer appearance.

The method of the present invention results in a three dimensionnal appearance and broadens the styling or designing spectrum.

In one form of the invention, a plurality of variously colored resinous particles are mixed in accordance with an intented appearance to the final product while a wet ungelled plastisol or organosol is prepared; then a predetermined amount of the mixture of colored particles is deposited in the plastisol; then, the mixture is blended by slow agitation under vacuum.

The mixture is then placed on a sheet of flexible substrate which has a coating of plastisol, the coating bearing a printed design.

In one preferred form of the invention, the blended mixture, prior to being applied on the substrate is filtered to prevent passage of unwanted material, including mass agglomeration.

In a further form of the invention, once the blended mixture is gelled in an oven, it is smoothened by being passed between rotatable cylinders of a calender machine.

In a further form of the invention, the cylinders are cooled to increase the fixing of the particles.

OTHER OBJECTS AND STATEMENT OF THE INVENTION

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

FIG. 1 is a flow sheet diagram representing a typical process for making inlaids in accordance with the present invention.

DESCRIPTION OF PREFERRED EMBODIMENTS

Figure 1:
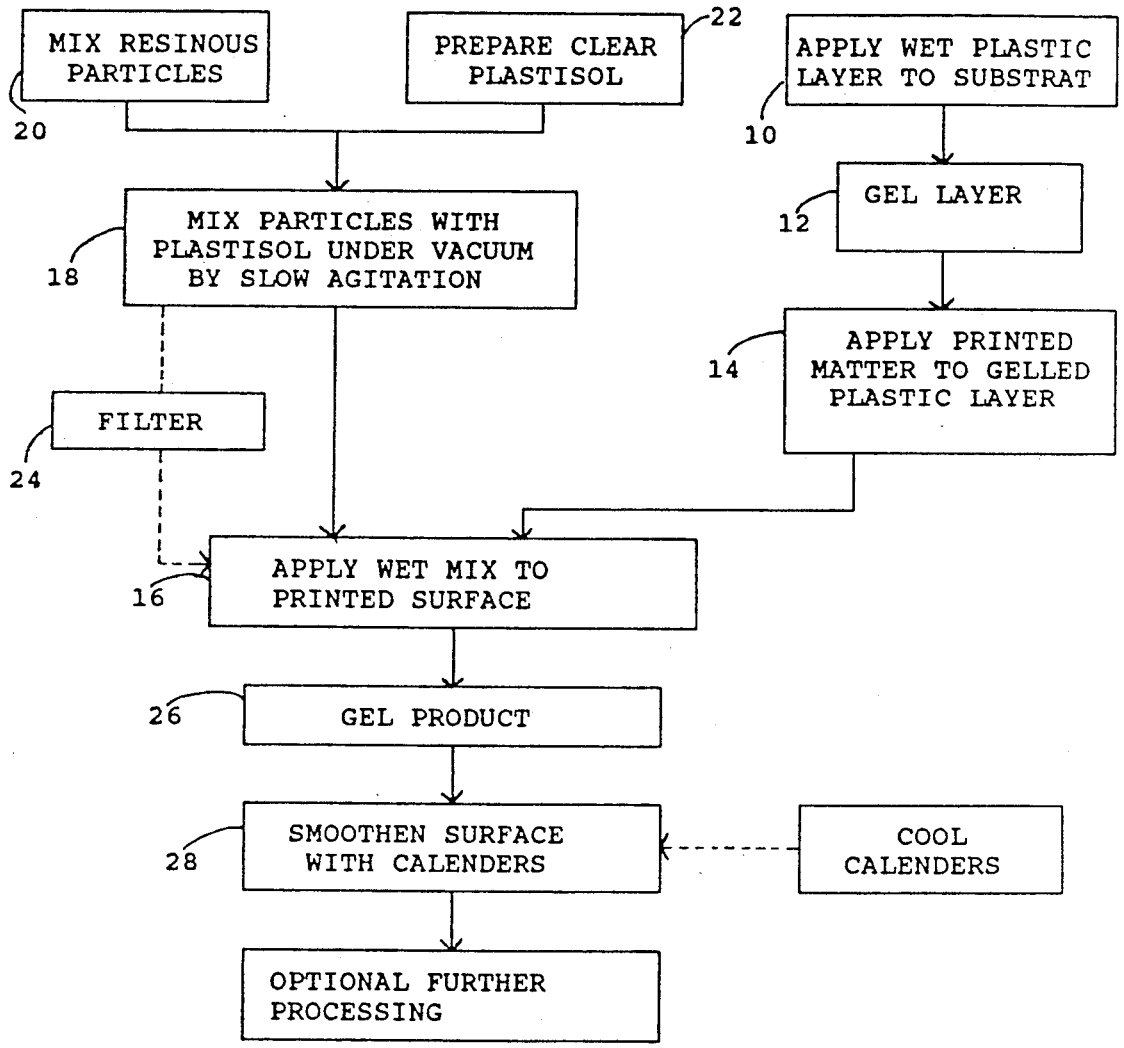

Referring to FIG. 1, it can be seen that various steps are prepared separately.

A wet plastic layer is applied to a substrate. The various materials which can be used for the construction of a substrate or for a substrate layer are well known to those skilled in the art of manufacture of floor or wall covering products. It is not deemed necessary to review all these various materials, some of which are found described, for example, in the above-mentionned U.S. Pat. No. 4,794,020.

Since this application makes numerous references to the term "plastisol", it will only be mentionned that it is a relatively high molecular weight polyvinyl chloride (PVC) resin dispersed in one or more plastisizers. For purpose of the present invention, plastisol compositions are intended to include also organosol; it should be mentionned, however, that organosol contains one or more volatile liquids that are driven off upon heating.

Referring to the block diagram of FIG. 1, a wet plastic application step 10 is followed by a gellation step 12 which is then followed, if desired, by a printing step 14. The application, gellation and printing steps are well known in the art and may be found described in detail in U.S. Pat. Nos. 3,293,108 and 4,017,658.

The present invention is particularly concerned with coating the gelled plastic layer bearing a printed design with a wet mix of particles and plastisol.

This wet mix has been prepared by blending particles of resinous material with the plastisol in a mass agitator by slow agitation under vacuum, step 18. The mixture of the particles with the plastisol results from two separate steps which consist: (20) mixing a plurality of variously colored particles and (22) preparing a clear plastisol which is deaerated under vacuum.

Before the application of the wet mix to the printed surface at (16), the mixture may optionnaly be filtered at (24) to a mesh size greater than that of particles to avoid agglomeration and contamination.

After step 16, the product is gelled in an oven at a temperature which is lower than the temperature used at step 12. This is followed by a smoothening operation 28 which consists in smoothening the surface of the product by passing the product between the pressure rolls of a calender device. Preferably, the rolls are cooled, so that the temperature is lower than the temperature of the product being processed. The cylindrical surface of the rolls may have a flat surface or a textured surface depending on the finish to be given to the product.

The product which exits from the calender may be subject to various optionnal steps, one of which is to cover the product with a layer of plastic material. This is followed by a gellation step which provides the en ire fusing of the product and the obtention of a three-dimensionnal effect. Then, this is followed by a cooling process and the product is thus obtained.

The following examples are intended to demonstrate preferred embodiments of this invention without limitating the scope thereof. In the following examples all parts percentages are by weight.

EXAMPLE 1

A floor covering substrate sheet of conventional non-asbestos felt approximately 25 mils thick is coated with 30 mils of non-foamable coloured plastisol base coat. The composition is as follows:

| | PARTS BY WEIGHT |
|---|---|
| PVC Emulsion resin K value: 70 (Pevikon* 11F) | 60 |
| PVC Extender resin RV: 2.25 (Oxy* 567) | 40 |
| Di (2 ethyl hexyl) phthlate | 105 |
| Di Iso Decyl Phthlate | 4.5 |
| Expoxidized soy bean oil | 5 |

-continued

| | PARTS BY WEIGHT |
|---|---|
| Calcium carbonate | 304 |
| Viscosity reducing agent BYK* 4010 | 17 |
| Titanium dioxide | 23 |
| Barium zinc type stabilizer (Irgastab* BZ512) | 2 |
| Mineral Spirit | 11.5 |

*trade mark

The coated substrate is then gelled in a hot oven at 135° C. for 2 minutes. The surface is then printed on a multihead gravure press using vinyl inks produced by Domco Industries Limited.

After printing a plastisol-chip mixture about 28 mils thick is applied using a knife over roll coater. Approximately 935 gm/m$^2$ are applied at a viscosity of 3300 cps—spindle4–20 RPM25° C.

The composition of the clear plastisol is:

| | PARTS BY WEIGHT |
|---|---|
| PVC dispersion resin: relative viscosity: 2.30 (Oxy* 68 HC) | 97 |
| PVC extender resin: relative viscosity: 2.25 (Oxy* 567) | 3 |
| Phosphate esther Reofos* 50 of Ciba Geigy | 5.5 |
| Monoisobutyrate Monobenzoate Ester (Nuoplaz* 1046-Huls Chemicals) | 32 |
| Texanol Isobutyrate (TXIB) | 10 |
| Butyl Benzyl Phthlate | 13 |
| Stabilizer, Barium-zinc type (Synpron* 1363) | |
| The composition of the dry blend chips is: | |
| Suspension grade PVC resin (relative viscosity 2.4) (Vygen* 300XL) | 100 |
| Di (2 ethyl hexyl) Phthlate | 27 |
| Butyl Benzyl Phthlate | 27 |
| Stabilizer-Barium-Zinc (Irgastab* BZ 512) | 2.7 |
| Titanium Dioxide | 15.9 |
| Coloured pigments-pastes | 3.1 |

*trade mark

Purchased coloured pastes from Pan Chemicals, Hawthorne, N.J., are white, brown iron oxide, yellow, orange and red, dispersed in di (2 ethyl hexyl phthalate).

The Vygen* 300XL resin is a larger than normal suspension resin. It is round and the particle size average is 415 micron (approximately 35 mesh). Screen analysis is as follows:

| MESH | % RETAINED |
|---|---|
| 20 (833 micron) | .85 |
| 28 (569 micron) | .75 |
| 35 (416 micron) | 65.63 |
| 50 (294 micron) | 28.58 |
| Pan 50 mesh | 4.19 |

Once the vacuumed and plastisol-chip mixture has been applied onto the printed gelled structure, it is then heated in a hot air circulating oven for 3 minutes. The temperature profile is 204°, 230°, 230° C. per successive zone. At the exit from the oven, the top surface of the hot sheet is given a further infra red heat treatment to allow the material to be embossed mechanically with a specific design. The floor covering product thereby produced displays a relief structure (mechanical embossing). The decorative inlaid product has an average thickness of about 80 mils and exhibits excellent wear and design characteristics.

EXAMPLE 2

A floor covering substrate sheet of standard type non-asbestos felt approximately 30 mils thick is coated with 10 mils of a foamable plastisol the composition of which is as follow:

| | PARTS BY WEIGHT |
|---|---|
| PVC dispersion resin K value:67 (Oxy* 625) | 70 |
| PVC extender resin relative visc. 2.25 (Oxy* 567) | 30 |
| Butyl Benzyl Phthlate | 35 |
| Di (2 ethyl hexyl) Phthlate | 8 |
| Texanol Isobutyrate (TXIB) | 12 |
| Titanium Dioxide | 5.5 |
| Snowhite* #9 (calcium carbonate) | 11.0 |
| Antimony Trioxide | 5.5 |
| Azo Dicarbonamide | 3.4 |
| Zinc oxide | 1.0 |
| Mineral spirit | 3.0 |
| Brookfield HBT*-viscosity 2800 CPS-spindle 4-20 rpm-25° C. | |

*trade mark

The coated substrate is then gelled in a hot air circulating oven at 140° C. for 2 minutes. The surface is then printed on a multihead gravure press using vinyl inks prepared by Domco Industries Limited. The ink used to print the valley area of the (registered and non-registered embossing) pattern contains additionally 15 parts of trimellitic anhydride (TMA) to suppress in specific areas the decomposition of the foamable plastisol.

After printing, the vacuumed chip—plastisol mixture is applied 22 mils thick using a knife over roll coater. A total of 770 gm/m$^2$ of chip—plastisol mixture is coated of which 13% is a blend of white, blue, tan and black dry blend chips. The blend is prepared in the following ratio white, tan, blue and black 92.5 /4 /3 0.5.

The composition of the clear plastisol is:

| | PARTS BY WEIGHT |
|---|---|
| PVC dispersion resin: relative viscosity: 2.30 (Oxy* 68 HC) | 97 |
| PVC extender resin: relative viscosity: 2.25 (Oxy* 567) | 3 |
| Phosphate esther Reofos* 50 (Ciba Geigy) | 5.5 |
| Monoisobutyrate Monobenzoate Ester (Nuoplaz* 1046-Hüls Chemicals) | 32 |
| Texanol Isobutyrate TXIB | 10 |
| Butyl Benzyl Phthlate | 13 |
| Stabilizer, Barium-zinc type (Synpron* 1363) | 3 |
| | PARTS BY WEIGHT-COLOURED |
| The composition of the dry blend chips is: | |
| Suspension grade PVC resin (relative viscosity 2.4) (Vygen* 300XL) | 100 |
| Di (2 ethyl hexyl) Phthlate | 27 |
| Butyl Benzyl Phthlate | 27 |
| Stabilizer-Barium-Zinc (Irgastab* BZ 512) | 2.7 |
| Titanium Dioxide | 15.9 |
| Coloured pigments-pastes | 3.1 |

*trade mark

Purchased coloured pastes from Pan Chemicals, Hawthorne, N.J., are white, brown iron oxide, yellow, orange and red, dispersed in di (2 ethyl hexyl phthalate).

The floor covering product thereby produced displays a relief structure (embossing) in register with the printed areas. To protect the surface even further another protective coating of 1 mil dry of water base polyurethane is supplied and has the following composition:

| | PARTS BY WEIGHT |
|---|---|
| Water base polyurethane coating-Permuthane coating 35& solid | 100 |
| Flattening agent | 2.5 |
| Antifoaming agent (BYK* chemical) | .125 |
| Viscosity Zahn: cup #2-21 seconds | |

The wet 3 mils of polyurethane coating is applied on the embossed product using an air knife.

It is then dried and cured in a hot air circulating oven for 2 minutes. The temperature profile is 121°/204°/204° C. in successive zones.

The floor covering product thereby produced exhibits excellent wear and design characteristics.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. In a method for making decorative inlaid types of sheet materials, which comprises forming, on a sheet of flexible substrate, a plastic layer of plastisol or organosol containing resinous porous particles, the improvement comprising the steps of:

a) blending the resinous particles with the plastisol or organosol by slow agitation, under vacuum; and b) applying the blended mixture of resinous particles and plastisol or organosol on the sheet of flexible substrate.

2. In a method for making decorative inlaid types of sheet materials, which comprises forming, on a sheet of flexible substrate, a plastic layer of plastisol or organosol containing resinous porous particles, the improvement comprising the steps of:

a) mixing, in a predetermined ratio, the resinous particles with the plastisol or organosol;

b) blending the mixture by slow agitation, under vacuum; and c) applying the blended mixture of resinous particles and plastisol or organosol on the sheet of flexible substrate.

3. In a method for making decorative inlaid types of sheet material, which comprises forming, on a sheet of flexible substrate, a plastic layer of plastisol or organosol containing resinous porous particles, the improvement comprising the steps of:

a) mixing a plurality of variously colored resinous particles;

b) preparing a wet ungelled plastisol or organosol;

c) depositing a predetermined amount of the mixture of colored particles in the plastisol or organosol; and d) blending the mixture of particles and plastisol or organosol by slow agitation, under vacuum; and e) applying the blended mixture of resinous particles and plastisol or organosol on the sheet of flexible substrate.

4. In a method as defined in claim 1, wherein the sheet of flexible substrate has a coating of plastisol or organosol, said coating bearing a printed design thereon.

5. In a method as defined in claim 1, wherein prior to said applying step, the blended mixture is filtered through a mesh having a size greater than the particle size.

6. In a method as defined in claim 1, comprising then gelling the blended mixture in an oven.

7. In a method as defined in claim 5, comprising then gelling the blended mixture in an oven.

8. In a method as defined in claim 6, further comprising, after gelling, smoothening the surface by passing the substrate between rotatable pressure cylinders.

9. In a method as defined in claim 8, wherein each said cylinder has a flat surface in contact with gelled material.

10. In a method as defined in claim 8, wherein said cylinder has a textured surface in contact with the gelled material.

11. In a method as defined in claim 9, wherein said cylinders are cooled.

12. In a method as defined in claim 8, further comprising the step of covering the smoothened surface with a layer of plastisol or organosol.

13. A method for making decorative inlaid types of sheet material, comprising the steps of:

a) applying a plastic layer of wet ungelled PVC plastisol or organosol on a sheet of flexible substrate;
b) gelling said plastic layer;
c) applying a printed design to the surface of the gelled plastic layer;
d) mixing a predetermined amount of variously colored polyvinyl chloride (PVC) dry-blend particles in a wet ungelled clear PVC plastisol or organosol by slow agitation, under vacuum;
e) applying the mixture of step d) to the design-applied surface of step c);
f) gelling the applied mixture of step e);
g) smoothening the surface of the gelled mixture of step f) by passing the substrate between pressure applying cylinders; and
h) applying a web plastisol on the smoothened surface of step g), gelling and fusing.

14. A method as defined in claim 13, wherein, prior to the mixing step, the plurality of variously colored are separately mixed.

15. A method as defined in claim 13, wherein the mixture is filtered through a mesh having a size greater than the particle size.

16. A method as defined in claim 13, wherein said cylinders are cooled.

17. A method as defined in claim 13, wherein said plastisol is foamable.

* * * * *